US007874231B2

(12) United States Patent
Hanlon

(10) Patent No.: US 7,874,231 B2
(45) Date of Patent: Jan. 25, 2011

(54) STRIKING TOOL

(75) Inventor: Jared Hanlon, Santa Clarita, CA (US)

(73) Assignee: Pull'r Holding Company, LLC, Elk Grove Village, IL (US)

( * ) Notice: Subject to any disclaimer, the term of this patent is extended or adjusted under 35 U.S.C. 154(b) by 0 days.

(21) Appl. No.: 12/589,846

(22) Filed: Oct. 28, 2009

(65) Prior Publication Data

US 2010/0116096 A1 May 13, 2010

Related U.S. Application Data

(63) Continuation of application No. 12/387,761, filed on May 6, 2009, now abandoned.

(60) Provisional application No. 61/050,963, filed on May 6, 2008.

(51) Int. Cl.
*B25D 1/12* (2006.01)
*B25D 1/00* (2006.01)

(52) U.S. Cl. ..... 81/22; 81/24

(58) Field of Classification Search ..... 81/22, 81/23, 20, 24; D8/78
See application file for complete search history.

(56) References Cited

U.S. PATENT DOCUMENTS

| | | | | |
|---|---|---|---|---|
| 6,619,408 | B1 * | 9/2003 | Lai | 173/90 |
| 6,763,747 | B1 * | 7/2004 | Gierer et al. | 81/489 |
| 6,848,341 | B2 * | 2/2005 | Pace et al. | 81/22 |
| 6,923,432 | B1 * | 8/2005 | Martinez | 254/26 R |
| 7,066,052 | B2 * | 6/2006 | Chen | 81/22 |
| 2006/0021473 | A1 * | 2/2006 | Deros et al. | 81/20 |
| 2006/0207391 | A1 * | 9/2006 | Chen | 81/22 |
| 2007/0089571 | A1 * | 4/2007 | Chen | 81/23 |
| 2008/0053278 | A1 * | 3/2008 | St. John et al. | 81/20 |

* cited by examiner

*Primary Examiner*—David B Thomas
(74) *Attorney, Agent, or Firm*—Cherskov & Flaynik

(57) ABSTRACT

A hammer that that reduces vibration and provides advantageous balance and mass distribution having a handle portion comprising an I-shape sectional profile and a head comprising a cavity formed therethrough. The hammer may further comprise various nail or other fastener removal structures, such as a claw, slots, notches, or the like. The hammer may further include a nail-starter with magnetic nail retention.

17 Claims, 6 Drawing Sheets

STRIKING TOOL

CROSS REFERENCE TO RELATED APPLICATIONS

This application claims the benefit of U.S. application Ser. No. 12/387,761 filed on May 6, 2009 currently pending the contents of which is hereby incorporated by reference, which in turn claimed priority to U.S. Provisional Application Ser. No. 61/050,963 filed on May 6, 2008, the contents of which is hereby incorporated by reference.

TECHNICAL FIELD

The present disclosure relates generally to hand tools, and, more particularly, to a striking tool, such as a hammer, or the like.

BACKGROUND OF THE INVENTION

For many different purposes, striking tools, such as hammers, or the like, have been employed for delivering or imparting an impact force to a selected target. Forces generated by even light-duty striking tools can be considerable due to the mechanical advantage involved with such tools. Accordingly, striking tools have been developed having durable, sometimes hardened materials, at least in a striking head or striking surface thereof, and are typically of robust design. Such durable materials, commonly metal, and such robust design, have produced massive tools.

While such tools exhibit acceptable durability characteristics, they are frequently disadvantageously heavy. As a result, a user may become strained or fatigued from use, resulting in poor control of strikes, damage to materials, or even injury. Consequently, efforts have been made to reduce the weight of striking tools to avoid strain or fatigue during use. Reduction of weight, however, affects a striking force delivered to the selected target when struck at a given velocity. Since certain tasks require substantial striking forces, reducing the weight of a striking tool is not always possible or beneficial. Instead, selective distribution of the mass of a striking tool may provide beneficial properties with respect to durability, ease and/or comfort of use, and strike force capacity.

Additionally, and particularly when used to deliver large force strikes, striking tools may disadvantageously transmit impact vibrations to a user through the handle. Such vibrations can accelerate the onset of strain or fatigue, and cause the user to experience discomfort. Furthermore, such vibrations can contribute to material strain and fatigue, causing damage to the tool itself, reducing tool life and posing a threat of injury. In order to avoid transmissions of such vibrations, striking tools have been provided with cushioned handles or the like. Such cushioned handles, however, fail to prevent vibrations within the tool, and merely serve to isolate a user's hand for comfort.

Finally, as is well known in the art, proper balance of a striking tool, i.e. distribution and location of mass between and within the head and the handle of the tool, contributes to reducing strain and/or fatigue and to improving accuracy.

Thus, it is clear that there is an unmet need for a striking tool that advantageously provides beneficial distribution of sufficient mass to safely and reliably allow accurate delivery of forceful strikes without causing excessive strain or fatigue.

BRIEF SUMMARY OF THE INVENTION

Briefly described, in an exemplary embodiment, the striking tool of the present disclosure overcomes the above-mentioned disadvantages and meets the recognized need for such a tool by providing a monolithic steel hammer having a head, a striking surface, a nail-pulling tool, and including one or more cavity and/or void, and a handle having a strong yet lightweight I-beam construction.

More specifically, the exemplary striking tool includes a generally extended handle portion, such as in the form of an I-beam, and a striking head integrally carried at a first end of the handle portion. The handle portion preferably includes a generally broad, flat forward surface adapted to reduce damage caused by overstrikes, i.e. poorly aimed strikes where an impact force is borne by the handle portion. A medial section of the handle portion, however, is generally thin compared to the broad forward surface. A broad rearward surface is preferably also included for stability and strength of the handle portion. The handle portion preferably additionally includes a comfortable grip operable therewith to provide a comfortable and secure gripping surface by which a user may grasp the striking tool.

The striking head preferably includes a transverse cavity extending therethrough, and a plurality of voids formed therein. The cavity preferably defines an upper beam portion and a lower beam portion. The beam portions preferably reduce vibrations caused by strikes, and substantially prevent transmission of vibrations to the handle portion, while allowing beneficial force transference from mass located on an opposite side of the cavity from the striking surface. More specifically, the striking face is preferably provided on a forward surface of the head, and the beam portions, particularly the upper beam portion, are arranged to substantially prevent compression along an axis of the head extending from the striking face to a rear portion of the head. The nail-pulling tool is preferably disposed proximate the rear portion of the head, as is conventional. The beam portions, particularly the lower beam portion, are arranged to substantially prevent bending between the nail-pulling tool and the handle portion.

Accordingly, one feature and advantage of the tool of the present disclosure is its ability to provide a strong, yet lightweight handle portion having a broad flat forward surface adapted to reduce damage caused by overstrikes.

Another feature and advantage of the tool of the present disclosure is its ability to provide a durable striking tool capable of delivering great impact forces while providing a beneficial weight distribution and balance for ease of use.

These and other features and advantages of the tool of the present disclosure will become more apparent to those ordinarily skilled in the art after reading the following Detailed Description of the Invention and Claims in light of the accompanying drawing Figures.

BRIEF DESCRIPTION OF THE DRAWINGS

Accordingly, the present disclosure will be understood best through consideration of, and with reference to, the following drawings, viewed in conjunction with the Detailed Description of the Invention referring thereto, in which like reference numbers throughout the various drawings designate like structure, and in which.

Figure 1:
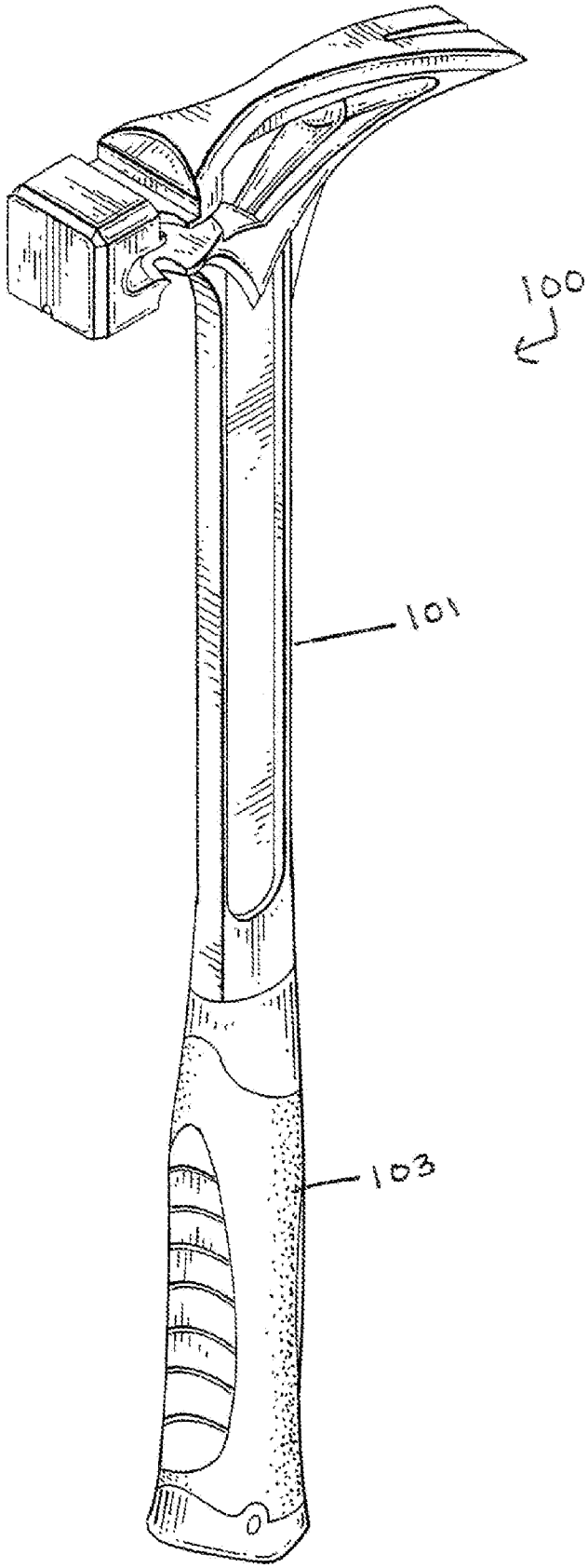
FIG. 1 is a perspective view of a hammer according to the present disclosure.

It is to be noted that the drawings presented are intended solely for the purpose of illustration and that they are, therefore, neither desired nor intended to limit the scope of the disclosure to any or all of the exact details of construction shown, except insofar as they may be deemed essential to the claimed invention.

DETAILED DESCRIPTION OF THE INVENTION

In describing exemplary embodiments of the hammer of the present disclosure illustrated in the drawings, specific terminology is employed for the sake of clarity. The claimed invention, however, is not intended to be limited to the specific terminology so selected, and it is to be understood that each specific element includes all technical equivalents that operate in a similar manner to accomplish a similar purpose.

In that form of the hammer of the present disclosure chosen for purposes of illustration, FIGS. 1-6 show hammer 100 including body 101 and grip 103. Body 101 is preferably formed as a monolithic or unitary member from a suitable metal, composite, or synthetic material, or the like, defining handle 110 and head 120, and includes grip 103 formed or installed thereon. Body 101 is preferably formed from steel. Grip 103 may be formed from natural or synthetic rubber, plastic, composite, or the like, and may be resilient and/or sculptured or contoured to provide a comfortable and secure grasping surface. Grip 103 is preferably disposed proximate first end 101*a* of body 101 proximate a distal end of handle 110. Head 120 is preferably disposed proximate a distal end of handle 110 at second end 101*b* of body 101.

Head 120 preferably includes claw 121 disposed on a rearward portion thereof and is adapted to pry articles, such as nails, boards, or the like, via application of force to handle 110. Striking surface 123 is preferably disposed on a forward portion of head 120 and is adapted to deliver a striking force to a selected target. Striking surface 123 may optionally include a plurality of teeth or other texture, such as a waffle pattern, a diamond pattern, or the like. Head 120 preferably further includes cavity 125 formed therethrough and a plurality of beams 127. Cavity 125 preferably serves to reduce a total mass of head 120 and to reduce transmission and/or creation of vibrations as may occur from striking impacts. Additionally, beams 127 preferably function to transmit force applied to handle 110 and momentum force from the mass of head 120 proximate claw 121 in order to deliver the striking force. Accordingly, beams 127 are substantially incompressible in a direction of such force transmission, i.e. along a respective longitudinal axis of each such beam 127. Beams 127 are operable, however, to absorb and/or dissipate off-axis forces, such as those that may cause vibration. Thus, vibrations are preferably not substantially transmitted to handle 110. Head 120 preferably additionally includes voids 129 formed therein at selected locations to both reduce the mass of head 120 and to produce a desired balance of head 120 while not substantially reducing a strength and/or durability thereof.

Handle 110 is preferably likewise configured to provide durability and/or strength while reducing a total mass thereof and while providing a beneficial balance or distribution of mass. Specifically, handle 110 preferably includes an I-shape cross-sectional profile, at least along a portion thereof. Such I-shape cross-sectional profile includes front and rear flanges 111 and 112, respectively, and web 113. Front flange 111 preferably provides a broad surface adapted to reduce damage to handle 110 and/or a target caused by striking contact therebetween, such as due to an overstrike. Web 113 preferably resists bending and provides strength for handle 110 to allow generation and delivery of substantial striking forces by striking surface 123.

Figure 4:
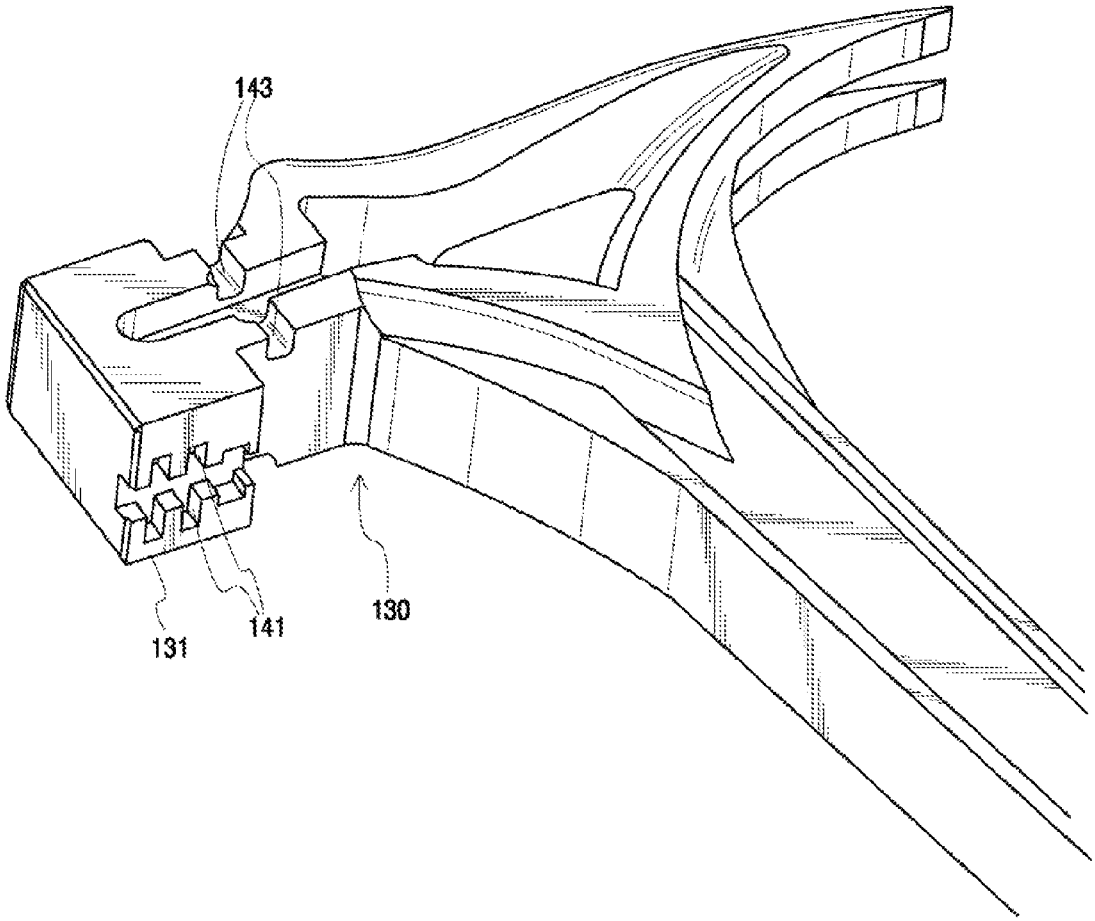
FIG. 4 is a detail view of the head of the hammer of FIG. 1.
Figure 5:
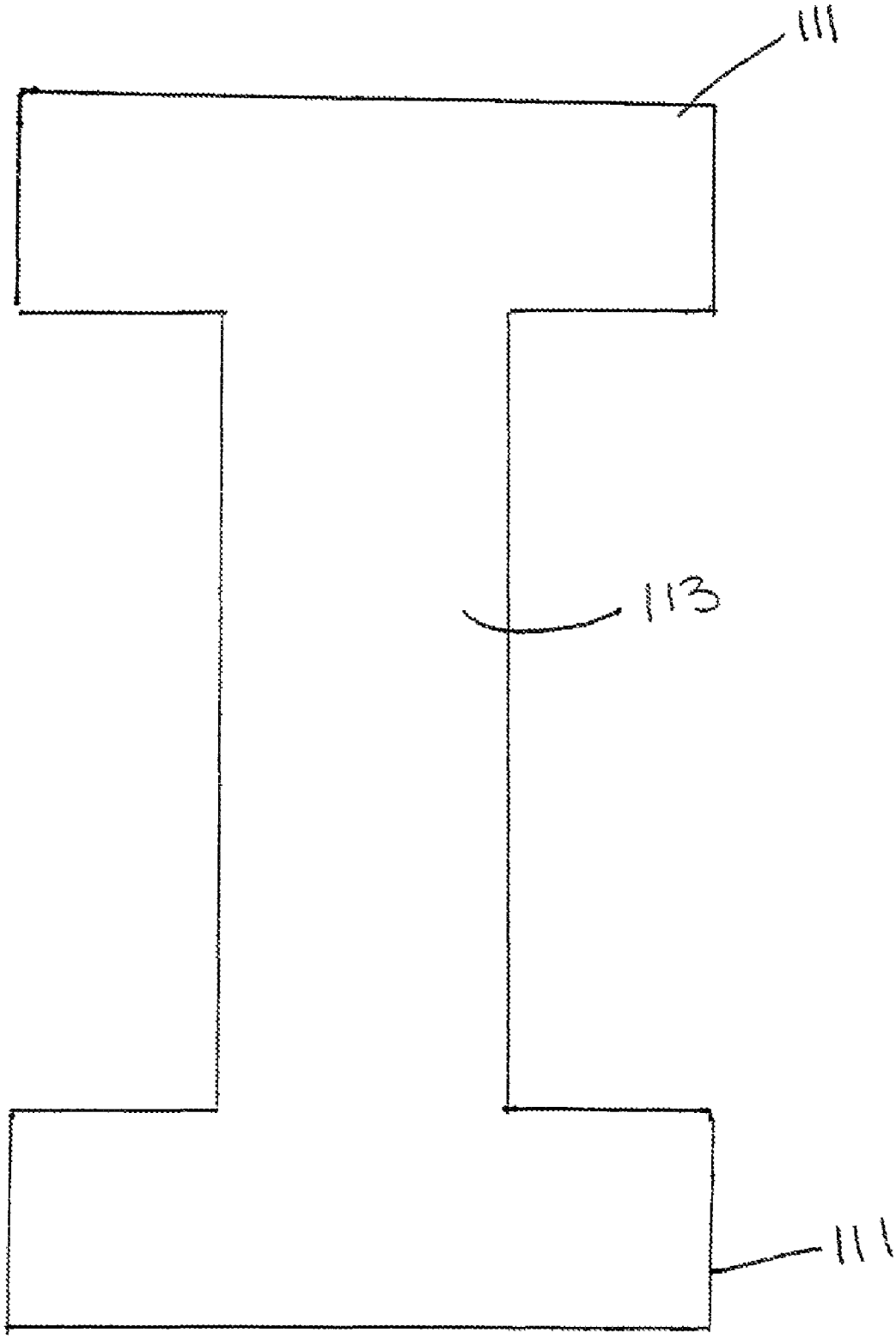
FIG. 5 is a sectional view of the handle of the hammer of FIG. 1.
Figure 6:
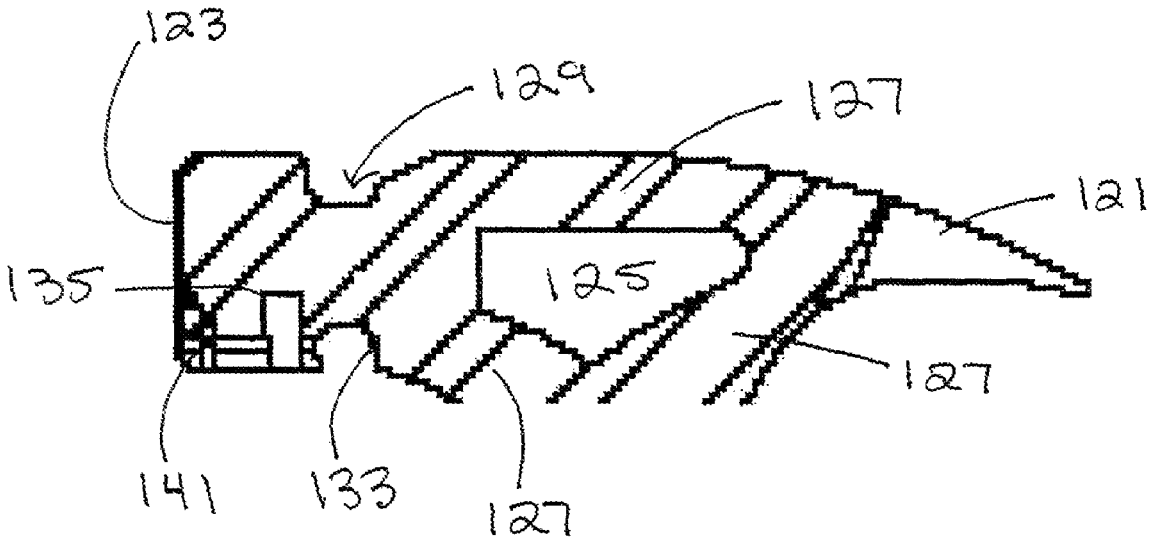
FIG. 6 is a sectional view of the head of the hammer of FIG. 1.

Now referring particularly to FIGS. 4 and 6, nail-starter 130 may optionally be included on an underside of head 120 for use in setting a nail for subsequent driving. Specifically, nail-starter 130 includes channel 131 for receiving a shaft of a nail therein and anvil surface 133 for engaging a head of the nail. Magnet 135 may be included in head 120 for magnetically retaining the nail in the channel during the starting process. As will be understood by those ordinarily skilled in the art, nail-starter 130 may alternatively be formed on a top of head 120 if desired, or in another location. However, the underside of head 120 is the preferred location for nail-starter 130 due to a user's ability to accurately start a nail which is enhanced by such positioning of nail-starter 130. Furthermore, when nail-starter 130 is disposed on a bottom or underside of head 120, the arc of travel of head 120 made during a striking motion used to start the nail preferably tends to retain the nail within channel 131 and in secure engagement with anvil surface 133 during setting.

Figure 2:
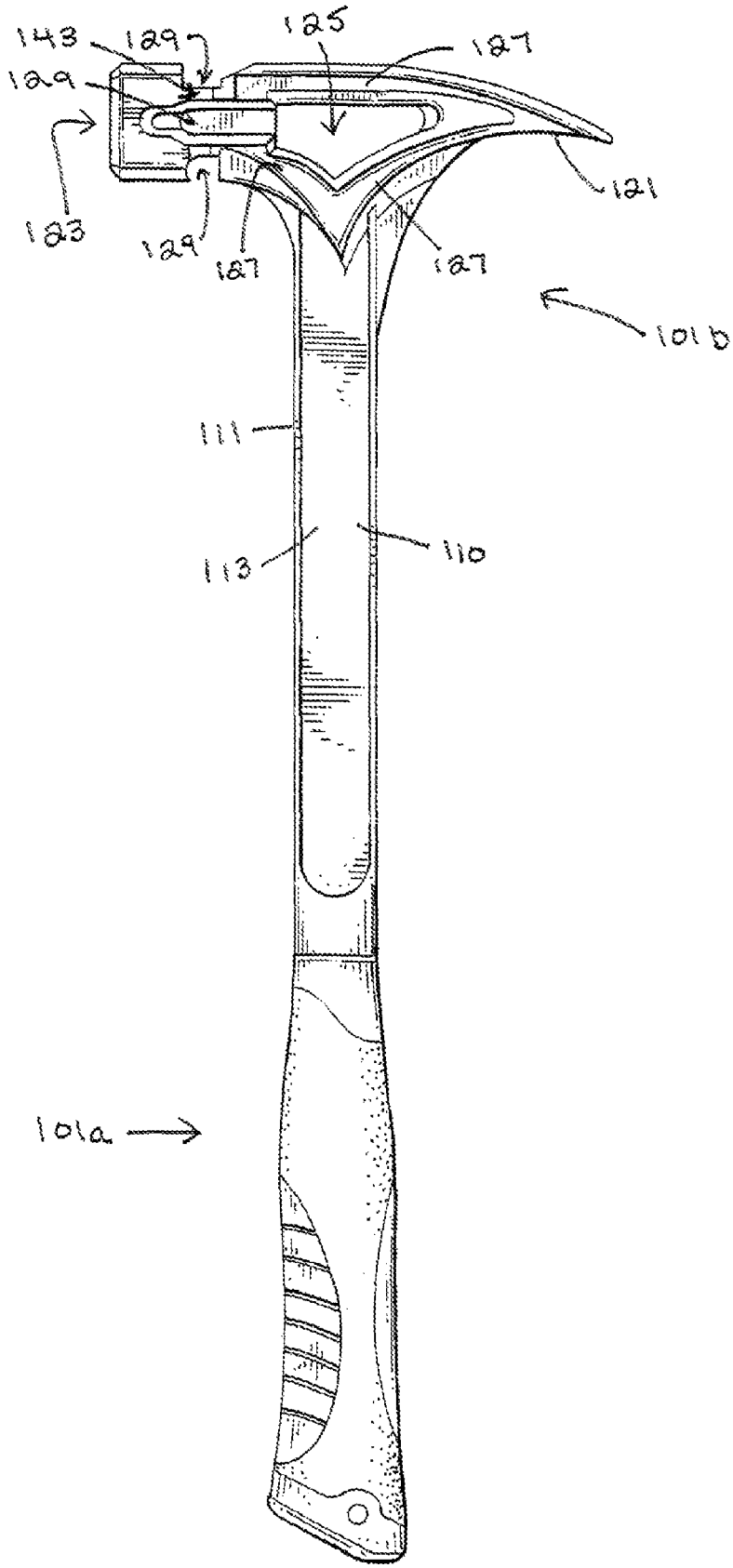
FIG. 2 is a side view of the hammer of FIG. 1.
Figure 3:
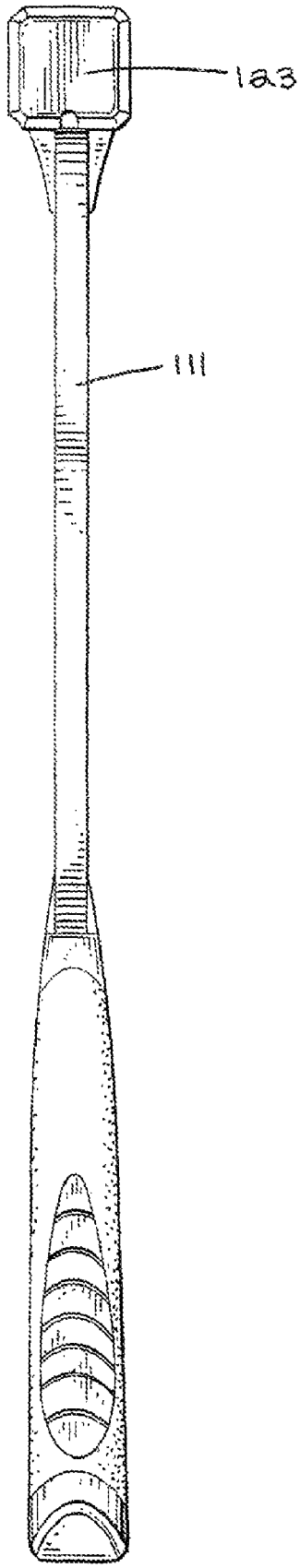
FIG. 3 is a front view of the hammer of FIG. 1.

As a further option, and with particular reference to FIGS. 2, 4, and 6, nail-puller slots 141 and nail-puller notches 143 may be provided at convenient locations over body 101, such as on an underside of head 120 or on a side of head 120. Nail-puller slots 141 are preferably configured to receive a portion of the head of a nail, whereby a leverage force may be applied thereto to remove the nail from an object. Similarly, nail-puller notches 143 are preferably configured to engage a portion of the nail shaft proximate the head and a lower surface of the nail head to apply a leverage force for removing the nail from an object.

In use, hammer 100 may be used to drive a nail or the like by engaging a shaft of the nail with channel 131 of nail-starter 130 such that a head of the nail abuts anvil surface 133 and such that the nail is retained within channel 131 via magnet 135. A user may then drive the nail into a target by swinging head 120 via handle 110 such that anvil surface 133 applies a driving force. Preferably, the nail may be removed from channel 131, overcoming a retention force, via frictional engagement with the target and a removal force applied to handle 110 by the user. The user may then swing hammer 100 to deliver a striking force by impacting the head of the nail with striking surface 123. If desired or necessary, a nail may be removed from an object via engagement of claw 121 with the shaft of the nail under the head and applying a levered extraction force via handle 110. Additionally or alternatively, slot 141 may be engaged with the nail head to apply an extraction force. Likewise, notch 143 may be engaged with the nail shaft beneath the head of the nail to apply an extraction force.

Having thus described exemplary embodiments of the present invention, it should be noted by those skilled in the art that the within disclosures are exemplary only and that various other alternatives, adaptations, and modifications may be made within the scope and spirit of the present invention. For example, while cavity 125 has been described and illustrated as defining a closed-loop aperture through head 120, cavity 125 may be formed as an open-loop aperture, such as when cavity 125 extends to an exterior perimeter of head 120. Accordingly, the present invention is not limited to the specific embodiments as illustrated herein, but is only limited by the following claims.

The embodiment of the invention in which an exclusive property or privilege is claimed is defined as follows:

1. A striking tool for at least one of driving and removing a nail having a nail head and a nail shaft, the tool comprising:

a handle portion adapted to be removably received by a user having a first end and a second end; and a head connected to a first end of said handle portion;

wherein a region of the head defines a cavity extending transversely through the head, the head further comprises a striking surface adapted to hit a target at a first end of the head; and the head further defines a plurality of beams extending over a surface of the head wherein said beams extend in a direction substantially perpendicular to the striking surface of the head in order to absorb force which in the absence of said beams would be transmitted to the handle portion.

2. The striking tool of claim 1 wherein a cross-section of a portion of the handle is I-shaped.

3. The striking tool of claim 2 wherein the handle further comprises a front flange and a rear flange.

4. The striking tool of claim 3 wherein the handle further comprises a reinforcement web.

5. The striking tool of claim 1 wherein the cavity formed through the head defines an upper portion and a lower portion of said plurality of beams.

6. The striking tool of claim 5 wherein the cavity extends to an exterior perimeter of the head.

7. The striking tool of claim 1 further comprising a nail pulling tool wherein the nail pulling tool is located at an end of the head opposite to the first end.

8. The striking tool of claim 1 wherein the handle portion and the head are integrally formed from a single workpiece or substrate.

9. The striking tool of claim 8 wherein the handle further comprises a handle portion extending between the first end of the handle and the second end of the handle and wherein at least one region of said handle portion is encapsulated by a grip.

10. The striking tool of claim 8 wherein the unitary body further comprises a notch adapted to removably engage a nail.

11. The striking tool of claim 1 wherein the striking surface includes a plurality of textured elements.

12. The striking tool of claim 1 further comprising a nail starter integrally molded into the head wherein the nail starter comprises a nail receiving shaft, and an anvil surface.

13. The striking tool of claim 12 wherein the nail starter further comprises a magnet wherein said magnet is integrated into the head.

14. The striking tool of claim 1 wherein the beams are substantially incompressible in a direction of force applied by striking tool.

15. The striking tool of claim 14 wherein the beams absorb and dissipate forces other than the force applied by striking tool.

16. The striking tool of claim 14 wherein the head incorporates a claw extending from a surface opposite of the first surface.

17. A lightweight striking tool for at least one of driving and removing a nail having a nail head and a nail shaft, the tool consisting of:

a handle portion adapted to be removably received by a user having a first end and a second end; and a head connected to a first end of said handle portion;

wherein a region of the head defines a cavity extending transversely through the head, the head further comprises a striking surface adapted to hit a target at a first end of the head; and the head further defines a plurality of beams extending over a surface of the head wherein said beams extend in a direction substantially perpendicular to the striking surface of the head in order to absorb force which in the absence of said beams would be transmitted to the handle portion.

* * * * *